US006637325B2

(12) United States Patent
Inamine

(10) Patent No.: US 6,637,325 B2
(45) Date of Patent: Oct. 28, 2003

(54) REWRITABLE-PROGRAM COMPUTER INTERFACE FOR STENCIL PRINTER, AND METHOD OF REWRITING PROGRAM FOR THE INTERFACE

(75) Inventor: Noboru Inamine, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 10 days.

(21) Appl. No.: 09/905,895

(22) Filed: Jul. 17, 2001

(65) Prior Publication Data

US 2002/0005125 A1 Jan. 17, 2002

(30) Foreign Application Priority Data

Jul. 17, 2000 (JP) ..... 2000-215353

(51) Int. Cl.[7] ..... B41C 1/14
(52) U.S. Cl. ..... 101/128.4; 101/129
(58) Field of Search ..... 101/115, 116, 101/128.9, 129; 400/76, 70, 33; 710/20; 713/200

(56) References Cited

U.S. PATENT DOCUMENTS 5,201,027 A * 4/1993 Casini ..... 395/107
5,528,376 A * 6/1996 Inoue et al. ..... 358/296
6,272,638 B1 * 8/2001 Yasuoka ..... 713/200
6,345,875 B1 * 2/2002 Fuller et al. ..... 347/9
6,401,607 B2 * 6/2002 Yoneoka ..... 101/129

FOREIGN PATENT DOCUMENTS

EP 0 477 388 A1 4/1992 ..... G06F/15/72
JP 9(1997)-34657 A 2/1997 ..... G06F/3/12
JP 9(1997)-97173 A 4/1997 ..... G06F/3/12
WO WO 91/16685 10/1991 ..... G06F/15/72

* cited by examiner

*Primary Examiner*—Huan Tran
*Assistant Examiner*—Alfred Dudding
(74) *Attorney, Agent, or Firm*—Nixon Peabody LLP; Donald R. Studebaker

(57) ABSTRACT

A computer interface for a stencil printer includes a data receiving section which receives printing data or program rewriting data from a computer, a data processing section which converts the printing data from the computer into stencil making data according to a running program, and a video data output section which outputs the stencil making data to a stencil printer with stencil making system. The data processing section is provided with a nonvolatile memory consisting of a main program block which is rewritable and stores a main program and a start-up program block which is not rewritable and stores a start-up program. A main program rewriting section rewrites a main program in the main program block when the main program which has been stored in the main program block is invalid or when the data receiving section receives program rewriting data from the computer.

8 Claims, 6 Drawing Sheets

REWRITABLE-PROGRAM COMPUTER INTERFACE FOR STENCIL PRINTER, AND METHOD OF REWRITING PROGRAM FOR THE INTERFACE

BACKGROUND OF THE INVENTION

1. Field of the Invention

This invention relates to a computer interface for a stencil printer and a method of rewriting a program for the interface.

2. Description of the Related Art

When inputting data into a stencil printer in which a stencil making system is integrated with a printing system for mass-printing (such a stencil printer will be referred to as "a stencil printer with stencil making system" or sometimes referred to simply as "a stencil printer", hereinbelow), a data take-up method in which a stand-alone data take-up device integrated with a stencil printer such as an image scanner is employed has been conventionally mainly employed. Accordingly, conventionally even printing data made by a computer must be once printed out and the printing data must be taken in the stencil printer by reading the print-out by the image scanner or the like. Since almost all the printing data is recently made by a computer and since the data take-up method using a stand-alone data take-up device is not high in efficiency, a computer interface for a stencil printer which processes printing data from the computer to convert it into stencil making data and outputs the stencil making data directly to the stencil printer with stencil making system has been developed.

The computer interface generally comprise a data receiving section which receives data from a computer, a data processing section which converts the data from the computer into stencil making data, and a video data output section which outputs the stencil making data to a stencil printer with stencil making system. The data processing section comprises a control program storage section which stores a control program and a RAM which stores various pieces of data and a running program.

The "running program" is a printing data processing program for converting the printing data into stencil making data and is not preserved together with other pieces of data when power is turned off.

The control program includes various initialization programs which control the computer interface, a program having a copying function for copying programs to a RAM or a judging function to judge whether jump to the RAM is to be caused, a main program on the basis of which the running program in the RAM is made, and the like, and is stored in the control program storage section.

When the printing data sent from the data receiving section is to be converted into a stencil making data, the data processing section copies in the RAM a main program for data processing out of main programs stored in the control program storage section, and converts the printing data into a stencil making data, and sends the stencil making data to the video data output section.

The control program storage section comprises a non-volatile memory (a ROM or a flash memory) and the control programs stored in the control program storage section are preserved even when power is turned off.

Though the control programs are input into the control program storage section when the computer interface is shipped from the factory, version-up frequently becomes necessary after shipment for the purpose of eliminating the bugs, enhancing functions or changing the specifications.

When the control program storage section comprises a ROM, in order to make version-up of the control programs, power of the computer interface and devices related to the computer interface must be turned off and the ROM must be replaced by a ROM into which a new control program has been input or the control program stored in the ROM must be rewritten.

To the contrast, when the control program storage section comprises a flash memory, version-up of the control programs can be made without changing the hardware. However, the flash memory must be shifted to a program rewriting mode by a special operation. Though varying depending upon the maker, the flash memory is generally shifted to the program rewriting mode by turning on power of the computer interface while depressing one or more switches on the computer interface or by shifting the computer interface to an engineer development mode, which is not known by those other than the developers of the maker, and carrying out command processing. Since a slight mistake in this operation can result in a failure of the computer interface, this operation is not generally executed by the end user but executed by a maker side, e.g, a serviceperson of the maker or a maintenance engineer.

The control program storage section of a flash memory is advantageous over that of a ROM in that version-up of the control programs can be made without changing the hardware.

However in the case of control program storage section of a flash memory, there is a problem that a special operation is required to rewrite the control programs and a skilled operator is required to rewrite the control programs since the special operation can result in a failure of the computer interface.

Further, when an error occurs during rewriting of the control programs or during erasure of the blocks, or when accidental destruction of the control programs occurs, for instance, by accidental power turning off during rewriting of the control programs, the flash memory must be forced into the program rewriting mode. Further depending upon the severity of destruction of the control programs, even rewriting of the control programs sometimes becomes unfeasible.

Since version-up of the control programs is not executed only for debug, preserving both the old and new control programs so that one of the old and new control programs may be used depending on the environment has been required. The environment as used here means the whole printing system including the computer and the stencil printer. For example, the control programs for the computer interface corresponding to Windows 98 (Microsoft) are also applicable to Windows 95 (Microsoft). However since the control programs corresponding to Windows 95 less loads the CPU of the computer interface, the control programs of Windows 95-corresponding version are preferable to those of Windows 98-corresponding version. When computers of different operating systems use the same computer interface and the same stencil printer through a network such as a LAN (local area network) or a WAN (wide area network) or through remote access using, for instance, a modem, it is preferred in view of efficiency that a plurality of control programs coexist in a computer interface for a stencil printer and one of control programs is selected depending on the operating system of the computer which drives the stencil printer.

SUMMARY OF THE INVENTION

In view of the foregoing observations and description, the primary object of the present invention is to provide a computer interface for a stencil printer the control programs for which can be rewrote without a special operation and in which a plurality of control programs for different versions are selectively used.

Another object of the present invention is to provide an improved method of rewriting the control programs in such a computer interface.

In accordance with a first aspect of the present invention, there is provided a computer interface comprising a data receiving means which receives printing data and/or program rewriting data from a computer, a data processing means which converts the printing data from the computer into stencil making data according to a running program, and a video data output means which outputs the stencil making data to a stencil printer with stencil making system, wherein the improvement comprises that the data processing means is provided with a nonvolatile memory consisting of a main program block which is rewritable and stores a main program and a start-up program block which is not rewritable and stores a start-up program, and a main program rewriting means rewrites a main program in the main program block when the main program which has been stored in the main program block is invalid or when the data receiving means receives program rewriting data from the computer.

The "nonvolatile memory" means, for instance, a ROM or a flash memory which can hold the contents of memory even when it is disconnected from a power source.

Since the main program block should be rewritable, the main program block is formed of a rewritable memory such as a flash memory. The start-up program block may be formed of either a flash memory or a ROM which is not rewritable.

It is preferred that the computer interface of the present invention be further provided with a main program rewrite requirement, judging means which sets main program identification information in the main program block and judges whether the main program is invalid and determines whether the main program is to be rewrote on the basis of the main program identification information while the data processing means is executing the start-up program after a power source of the computer interface is turned on.

When none of the main programs stored in the main program block is valid, it is determined that the main programs are invalid, and when at least one of the programs stored in the main program block is valid, it is determined that the main programs are valid.

The main program identification information means information which is to be set after the valid main programs are rewrote and on the basis of which the rewrote main programs are distinguishable. It is preferred that the main program identification information be on the version of the new main program though it may be information indicating that rewriting of the main programs is successfully ended or the time at which rewriteing of the main program is normally ended.

Since the main program identification information is deleted before the preceding main program is erased and set after the preceding main program is replaced by a new main program, the main program block which bears the main program identification information is turned to 0×FF in the case of failure in rewriting the main program, and the start-up program reads the main program identification information and judges whether preceding rewriting of the main program is successfully ended or the present main program is valid.

Further, it is preferred that the computer interface of the present invention be further provided with a switching means which switches the computer interface to a state where the main program is rewritable when the data receiving means receives the program rewriting data from the computer even if the main programs have been fully destructed, none of them are valid or a main program is being executed.

It is preferred that a plurality main programs of different versions be stored in the main program block and the start-up program be provided with a main program selecting means which selectively executes a main program of a selected version.

For example, by keeping a main program of a certain version left in the main program block after the main program block is loaded with a main program of another version, a plurality of main programs of different versions can be stored in the main program block.

In accordance with a second aspect of the present invention, there is provided a method of rewriting a program for a computer interface which receives printing data from a computer and outputs stencil making data to a stencil printer with stencil making system, wherein the improvement comprises the steps of storing a main program of a control program in a main program block of a nonvolatile memory which is rewritable, storing a start-up program of the control program in a start-up program block of the nonvolatile memory which is not rewritable, and rewriting the main program when the main program which has been stored in the main program block is invalid or when program rewriting data is input from the computer.

It is preferred that the method of the present invention further comprises the steps of setting main program identification information in the main program block and judging whether the main program is invalid on the basis of the main program identification information while the start-up program is being executed.

It is preferred that the method of the present invention further comprises the step of switching the computer interface to a state where the main program is rewritable when the data receiving means receives the program rewriting data from the computer even if the main programs have been fully destructed, none of them are valid or a main program is being executed.

It is preferred that a plurality of main programs of different versions be stored in the main program block and the start-up program selectively executes one of the main programs of a selected version.

As can be understood from the description above, the main program can be easily rewrote without necessity of special operation.

Further, when the computer interface of the present invention is further provided with a switching means which switches the computer interface to a state where the main program is rewritable when the data receiving means receives program rewriting data even if the main programs have been fully destructed, none of them are valid or a main program is being executed, the main program can be rewrote by only sending program rewriting data from a computer through not only known an IEEE1284 but also a network such as a LAN or a WAN or through remote access using, for instance, a modem.

Further, it is possible to arrange the computer interface so that a plurality of main programs of different versions are stored in the main program block and one of the main programs of a selected version are executed.

DESCRIPTION OF THE PREFERRED EMBODIMENT

Figure 1:
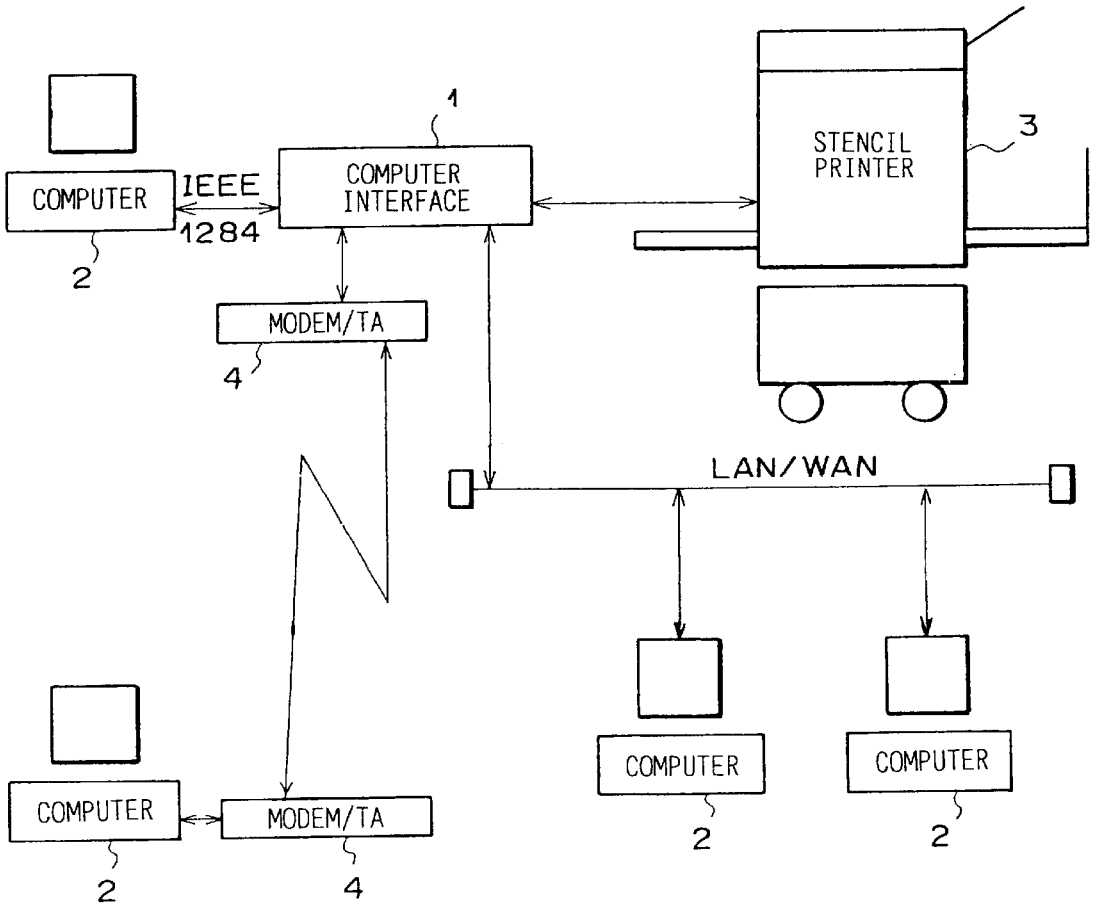
FIG. 1 is a view showing an example of a printing system including a computer interface for a stencil printer in accordance with an embodiment of the present invention.

A computer interface 1 in accordance with an embodiment of the present invention is connected to computers 2 and a stencil printer 3 in the manner shown in FIG. 1. That is, the computer interface 1 is connected to a computer 2 by way of an IEEE1284, to another computer 2 by way of modems or TA's 4 and to the other computers 2 by way of a LAN or WAN. The computer interface 1 receives printing data or program rewriting data from one of the computers 2. When receiving printing data, the computer interface 1 converts the printing data into stencil making data and outputs the stencil making data to the stencil printer 3, and when receiving program rewriting data, the computer interface 1 rewrites the main program according to the program rewriting data.

Figure 2:
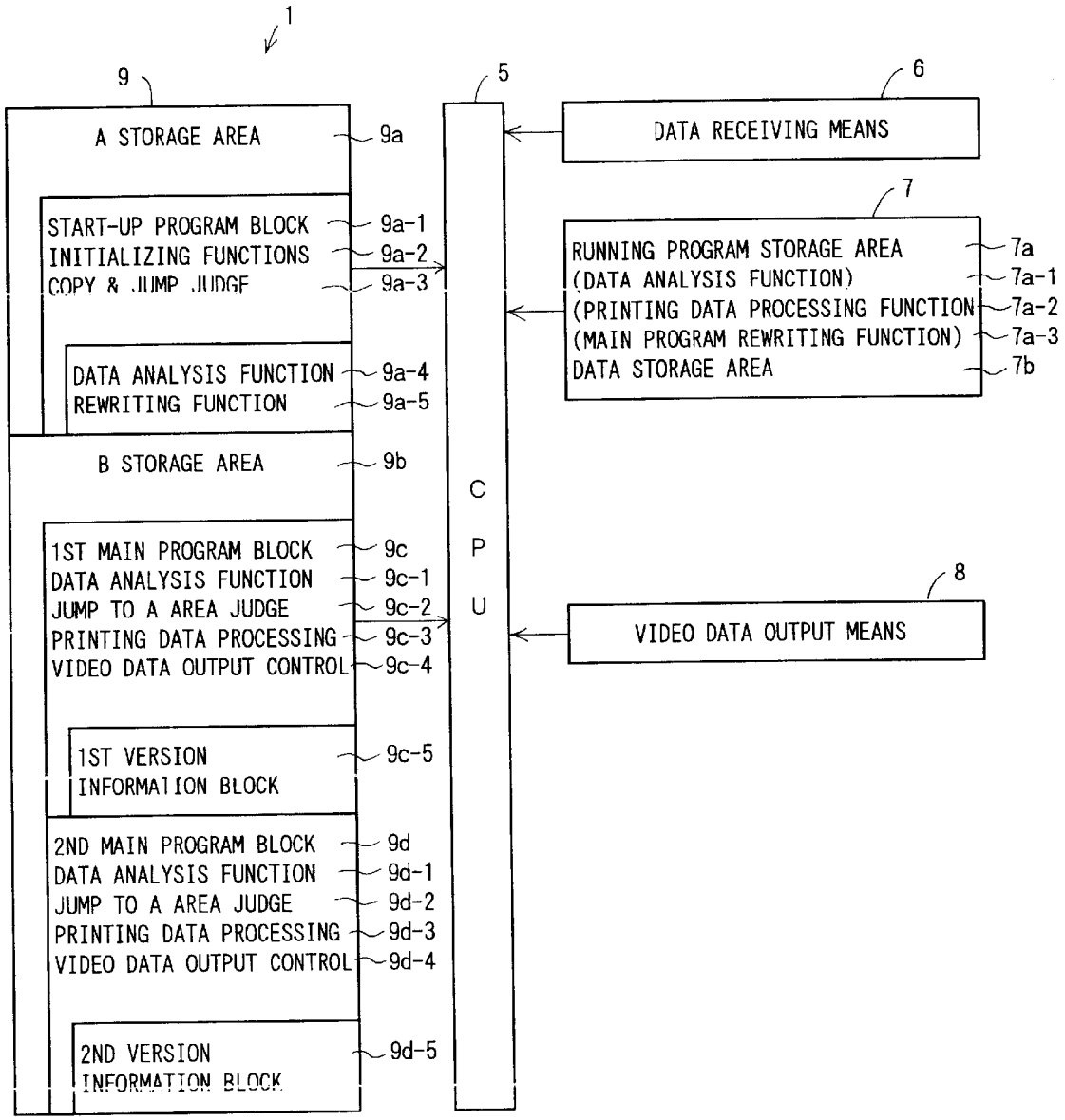
FIG. 2 is a schematic block diagram showing the computer interface of the embodiment of the present invention.

FIG. 2 shows the arrangement of the computer interface 1 of this embodiment.

As shown in FIG. 2, the computer interface 1 of this embodiment comprises a CPU 5, a data receiving means 6, a RAM 7, a video data output means 8 and a flash memory 9.

The CPU 5 reads data to be processed from the RAM 7 and processes the data. Then the CPU 5 writes the processed data in the RAM 7.

The data receiving means 6 receives printing data and/or program rewriting data and stores the data in the RAM 7. If necessary the data receiving means 6 may be arranged to transfer information on the state of the computer interface 1 to the computers 2 so that the computer operator can know the state of the computer interface 1.

The RAM 7 comprises a running program storage area 7*a* and a data storage area 7*b* in which various pieces of data are stored. The running programs stored in the running program storage area 7*a* include a data analysis function 7*a*-1, a printing data processing function 7*a*-2 and a main program rewriting function 7*a*-3. When printing data is to be processed, a program for processing printing data is loaded in the RAM 7 from the flash memory 9 as a running program, and printing data stored in the RAM 7 is converted into stencil making data according to the running program. Then the stencil making data is output to the stencil printer 3 through the video data output means 8. Rewriting of the main program by the RAM 7 will be described in detail later with reference to FIGS. 3 to 5.

The programs and data stored in the RAM 7 are all deleted when the power source is turned off.

The flash memory 9 is divided into an A storage area 9*a* in which a start-up program is stored and a B storage area 9*b* in which main programs are stored.

The video data output means 8 outputs to the stencil printer 3 one page of processed data by a video data output control function 9*c*-4 or 9*d*-4 provided in the B storage area 9*b* of the flash memory 9 each time it processes one page of printing data, and is formed by a port for communication with the stencil printer engine, a data output port and other output timing ports (as required).

The start-up program stored in a start-up program block 9*a*-1 of the A storage area 9*a* controls start-up of the programs upon turning on the power source and controls rewriting main program blocks 9*c* and 9*d* of the B storage area 9*b*. The start-up program has various initialization functions 9*a*-2 as well as a copying function for copying the start-up program and/or the main programs to the RAM 7 and a judging function to judge whether jump to the program area of the RAM 7 is to be caused (9*a*-3). The start-up program further has a data analysis function 9*a*-4 which analyzes rewriting data from a computer in a program rewriting mode and a rewriting function 9*a*-5 of rewriting the main programs stored in the B storage area 9*b*.

The main programs stored in first and second main program blocks 9*c* and 9*b* of the B storage area 9*b* have data analysis functions 9*c*-1 and 9*d*-1 which analyze data from a computer, judging functions 9*c*-2 and 9*d*-2 to judge whether jump to the A storage area is to be caused (when the data from the computer is program rewriting data, jump to the A storage area is caused), printing data processing function 9*c*-3 and 9*d*-4 for processing data from the computer when the data is printing data, and video data output control functions 9*c*-4 and 9*d*-4 which controls output of the processed printing data to the stencil printer 3.

The main program blocks 9*c* and 9*d* are respectively provided with version information blocks 9*c*-5 and 9*d*-5 in which version information on the versions of the main programs stored in the respective main program blocks 9*c* and 9*d* is set. When version information is set in the version information block 9*c*-5 or 9*d*-5, the main program stored in the corresponding main program block is valid, and when information other than the version information (e.g., 0×FF) is set in the version information block, the main program stored in the corresponding main program block is invalid.

Figure 3:
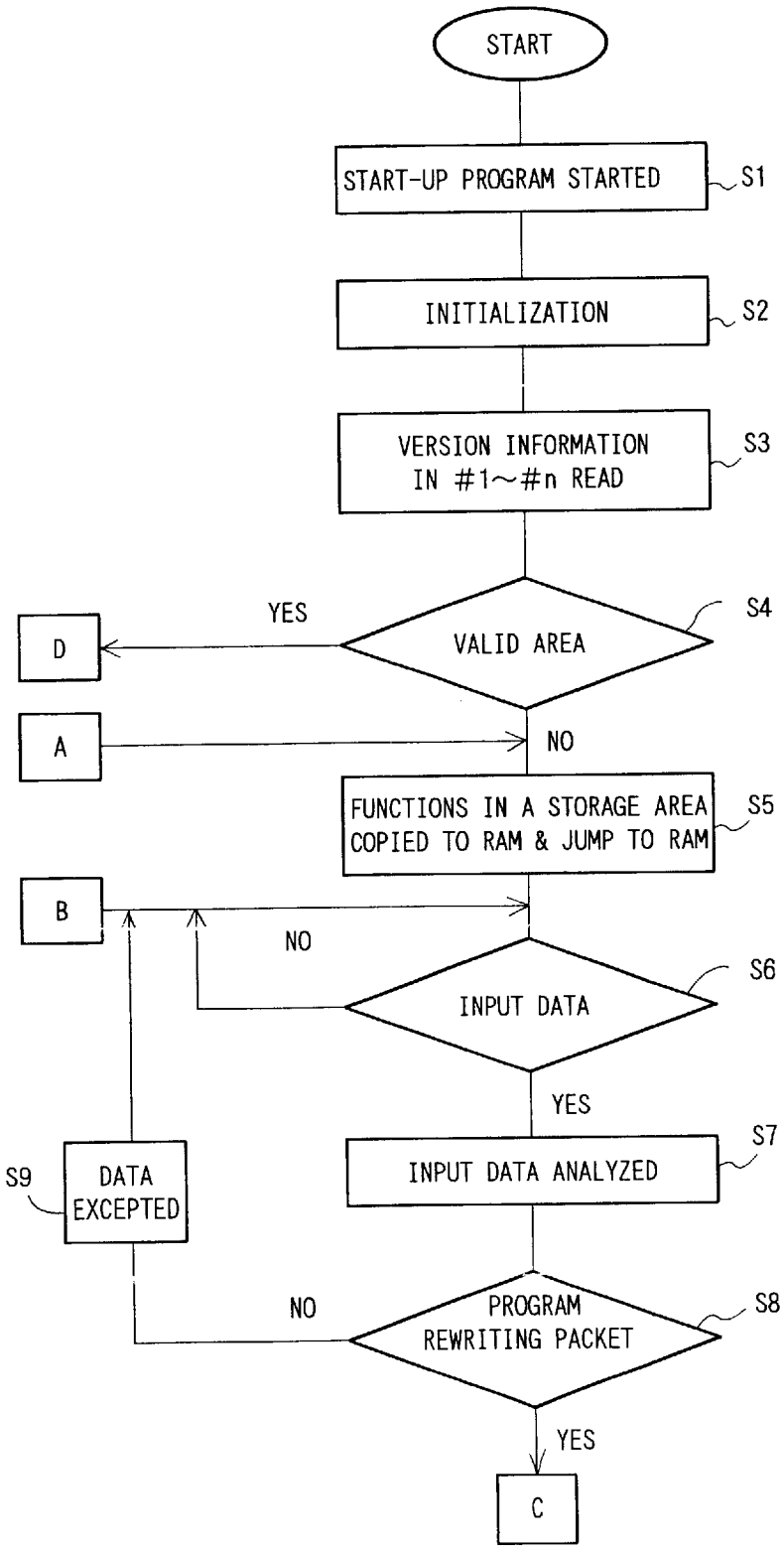
FIGS. 3 to 5 show a flow chart for illustrating the printing data processing and the program rewriting processing.
Figure 4:
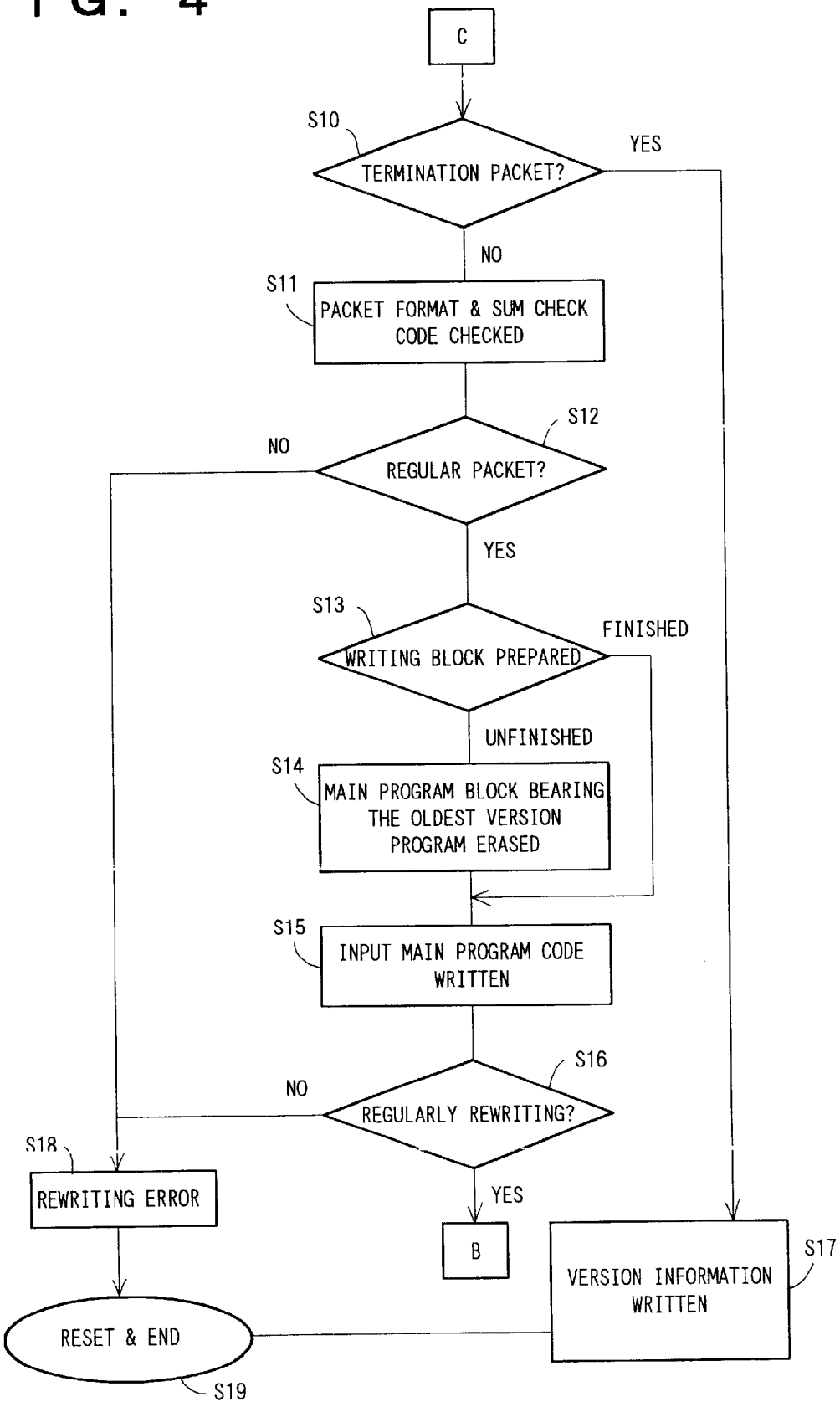
Figure 5:
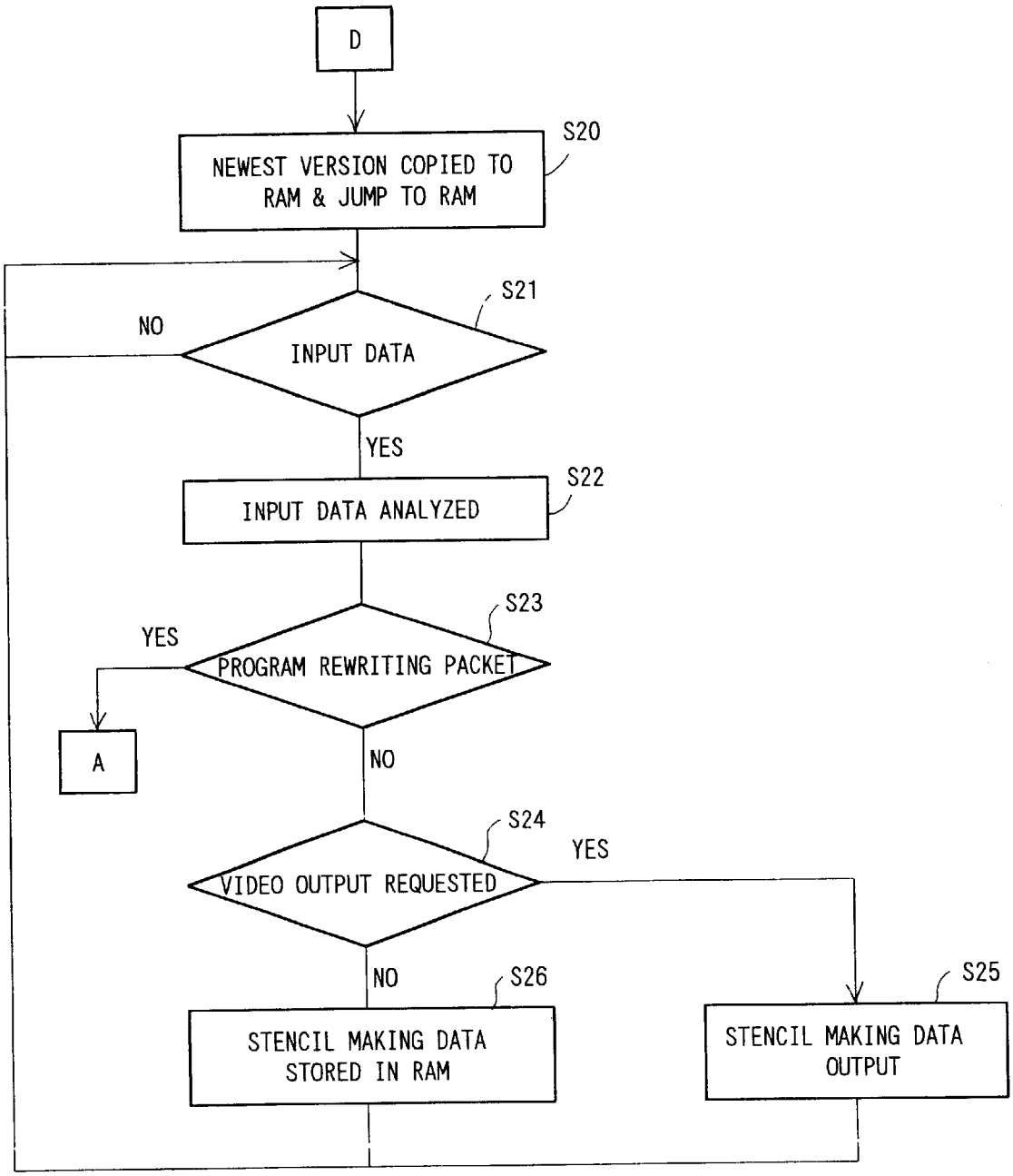

The printing data processing and the program rewriting processing carried out in the computer interface 1 of this embodiment will be described with reference to FIGS. 3 to 5, hereinbelow. When the power source is turned on, the start-up program is started up (step S1) and initialization processing is carried out (step S2). Then version information on the main programs respectively stored in all the main program blocks #1 to #n (n stands for the number of the main program blocks and is 2 in this particular embodiment) are read. (step S3).

Then it is determined whether there is a valid area bearing thereon a valid main program. (step S4) When it is determined that there is a valid area, steps S20 to S26 (D) shown in FIG. 5 are executed. Whereas, when it is determined that there is no valid area, i.e., that none of the main programs is valid, or when it is determined in step S23 (FIG. 5) that program rewriting data is sent from one of the computers 2, modules of the data analysis function 9*a*-4 and the rewriting function 9*a*-5 are transferred to the RAM 7, and thereafter jump to the RAM 7 is caused. (step S5) Then input of data from the computer 2 is waited for.

When it is determined in step S6 that data is input from a computer 2, the input data is analyzed by the data analysis function 9*a*-4 transferred to the RAM 7. (step S7) When it is determined in step S8 that the input data is a program rewriting packet, steps S10 to S19 (C) shown in FIG. 4 are executed.

To the contrast, when it is determined in step S6 that no data is input, or when it is determined in step S8 that the input data is not a program rewriting packet, the system is kept in this state until a program rewriting packet is input. When it is determined in step S8 that the input data is not a program rewriting packet, the input data is excepted. (step S9)

When it is determined in step S10 that the rewriting packet from the computer is a rewriting termination packet, version information is written in the version information block of the corresponding main program block (step S17), and the computer interface is reset (step S19). Thereafter the rewriting processing is ended. When it is determined in step S10 that the rewriting packet from the computer is not a rewriting termination packet, it is determined whether the rewriting packet is a regular packet on the basis of the packet format shown in FIG. 6A. (step S11 and S12) That is, when the format of the rewriting packet the system receives conforms to the format of the rewriting packet shown in FIG. 6A and the sum check code thereof is correct, it is determined that the rewriting packet is a regular packet. When it is determined that the rewriting packet is a regular packet, the input main program code is written in a selected storage area (writing block). (step S15) Before the input main program code is written, a writing block for writing the main program code, which has been erased and bears 0×FF, is prepared in the B storage area 9*b*. (step S13) When preparation of a writing block for writing the main program code has been finished, the main program code is written in the prepared writing block. On the other hand, when preparation of a writing block for writing the main program code has not been finished, the main program block bearing the oldest version main program is erased, that is, 0×FF is written in the main program block, (step S14), and then the input main program code is written in the main program block.

Then the written main program code is read by the system and whether it conforms to the original data is checked. (step S16) When it is determined that the written main program code conforms to the original data, that is, when it is determined that the main program code has been successfully rewrote, the system returns to step S6 in FIG. 3, and waits for another piece of input data. Otherwise, the rewriting processing is ended after the computer interface is reset. (step S19)

Figure 6A:
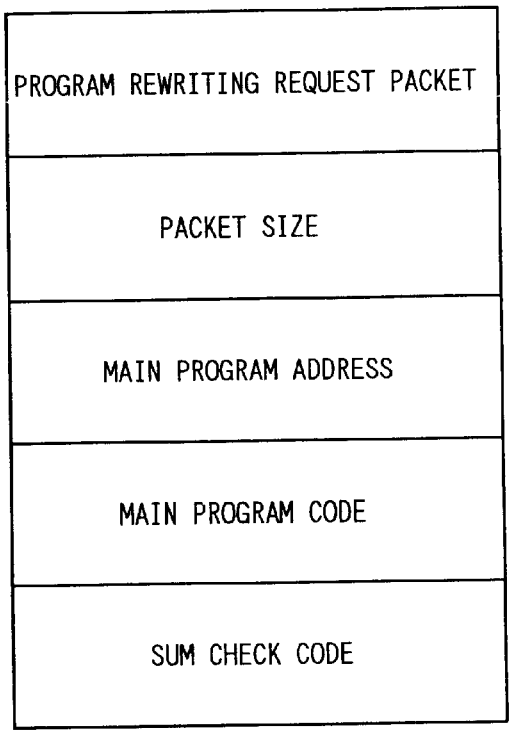
FIG. 6A is a view showing an example of the program rewriting data packet format.

When it is determined that the format of the rewriting packet the system receives does not conform to the format of the rewriting packet shown in FIG. 6A or the sum check code thereof is not correct, it is determined that the rewriting packet is not a regular packet, and the rewriting processing is ended after the computer interface is reset in step S19.

Figure 6B:
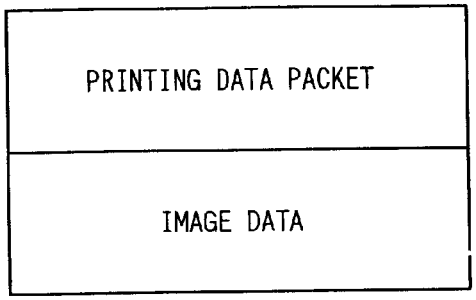
FIG. 6B is a view showing an example of the printing data packet format.

When it is determined that there is a valid area in step S4, the start-up program copies the main program of the newest version in the main programs stored in the main program blocks of the B storage area 9*b* to the RAM 7 and jumps into the RAM 7. Then the start-up program waits from input data. When there is data input into the system, the input data is analyzed. (steps S21 and S22) When the input data is a program rewriting packet, the program rewriting loop (steps S6~) is executed. When the input data is a printing data packet shown in FIG. 6B, the usual printing processing is executed and stencil making data is output to the stencil printer 3 or is stored in the RAM 7. (steps S24 to S26) Thereafter steps S21~ are executed. In this particular embodiment, the processing of writing the version information (step S17) is executed after that all the program rewriting packets have been regularly written. Accordingly, that the version information has been written is equivalent to that the main program is valid.

Though, in the embodiment described above, the main program identification information is employed as the version information, the version information may be data on the basis of which whether the main program is valid or invalid can be determined, e.g., a signal which is 0 when the main program is invalid and 1 when the main program is valid.

What is claimed is:

1. A computer interface for a stencil printer comprising a data receiving means which receives printing data and/or program rewriting data from a computer, a data processing means which converts the printing data into stencil making data according to a running program, and a video data output means which outputs the stencil making data to a stencil printer with stencil making system, wherein the improvement comprises that the data processing means is provided with a nonvolatile memory having a main program block which is rewritable and stores a main program and a start-up program block which is not rewritable and stores a start-up program, and a main program rewriting means rewrites a main program in the main program block when the main program which has been stored in the main program block is invalid or when the data receiving means receives program rewriting data from the computer.

2. A computer interface as defined in claim 1 further comprising a main program rewrite requirement judging means which sets main program identification information in the main program block and judges whether the main program is invalid and determines whether the main program is to be rewrote on the basis of the main program identification information while the data processing means is executing the start-up program after a power source of the computer interface is turned on.

3. A computer interface as defined in claim 1 further comprising a switching means which switches the computer interface to a state where the main program is rewritable when the data receiving means receives program rewriting data from the computer.

4. A computer interface as defined in claim 1 in which a plurality main programs of different versions are stored in the main program block and the start-up program is provided with a main program selecting means which selectively executes a main program of a selected version.

5. A method of rewriting a program for a computer interface which receives printing data from a computer and outputs stencil making data to a stencil printer with stencil making system, wherein the improvement comprises the steps of storing a main program of a control program in a main program block of a nonvolatile memory which is rewritable, storing a start-up program of the control program in a start-up program block of the nonvolatile memory which is not rewritable, and rewriting the main program when the main program which has been stored in the main program block is invalid or when program rewriting data is input from the computer.

6. A method as defined in claim 5 further comprising the steps of setting main program identification information in the main program block and judging whether the main program is invalid on the basis of the main program identification information while the start-up program is being executed.

7. A method as defined in claim 5 further comprising the step of switching the computer interface to a state where the main program is rewritable when the data receiving means receives the program rewriting data from the computer.

8. A method as defined in claim 5 characterized by the steps of storing a plurality of main programs of different versions in the main program block and arranging the start-up program to selectively execute one of the main programs of a selected version.

* * * * *